US006132127A

United States Patent [19]

Bedol

[11] Patent Number: 6,132,127

[45] Date of Patent: Oct. 17, 2000

[54] STORAGE APPARATUS FOR A BOOK

[76] Inventor: Mark A. Bedol, 3423 Yankton Ave., Claremont, Calif. 91711

[21] Appl. No.: 09/197,921

[22] Filed: Nov. 23, 1998

Related U.S. Application Data

[63] Continuation-in-part of application No. 08/769,504, Dec. 18, 1996, Pat. No. 5,876,144.

[51] Int. Cl.[7] ..... B42F 3/04

[52] U.S. Cl. ..... 402/4; 402/79; 281/30; 281/31

[58] Field of Search ..... 402/4, 79, 70, 402/73; 281/29, 36, 37, 45, 30, 31

[56] References Cited

U.S. PATENT DOCUMENTS

| | | | |
|---|---|---|---|
| 1,039,296 | 9/1912 | Krumming | 281/30 X |
| 1,308,437 | 7/1919 | Metcalfe | 281/30 |
| 1,894,241 | 1/1933 | Raynolds | 402/80 L |
| 1,904,572 | 4/1933 | Trussell | 402/4 |
| 2,097,626 | 11/1937 | Lesti | 402/4 |
| 2,160,392 | 5/1939 | Schade | 129/1 |
| 2,184,823 | 12/1939 | Vernon | 129/1 |
| 2,194,003 | 3/1940 | Brooks | 281/3 |
| 2,200,146 | 5/1940 | Block | 281/30 |
| 2,223,560 | 12/1940 | Friedlaender | 281/31 |
| 2,276,987 | 3/1942 | Kengott | 129/4 |
| 2,318,192 | 5/1943 | Boelema, Jr. | 281/31 |
| 2,453,459 | 11/1948 | Roberts | 129/4 |
| 2,505,694 | 4/1950 | Stuercke | 129/4 |
| 2,647,517 | 8/1953 | Bilbrey | 129/1 |
| 2,673,099 | 3/1954 | Hamilton | 281/15 |
| 2,704,077 | 3/1955 | Prillaman | 129/1 |
| 2,821,197 | 1/1958 | Bilbrey | 129/1 |
| 3,126,891 | 3/1964 | Caputi | 129/1 |
| 3,366,118 | 1/1968 | Beyer | 129/4 |
| 4,157,757 | 6/1979 | Gallaher, Jr. | 206/328 |
| 4,430,015 | 2/1984 | Nerlinger | 402/79 |
| 4,555,018 | 11/1985 | Cho | 206/214 |
| 4,595,309 | 6/1986 | Chinchar | 402/80 R |
| 4,704,042 | 11/1987 | Eisen et al. | 402/79 |
| 4,820,071 | 4/1989 | Steinfield et al. | 402/4 |
| 4,909,652 | 3/1990 | Harrison | 402/80 R |
| 4,918,632 | 4/1990 | York | 364/708 |
| 5,058,736 | 10/1991 | Bedol | 206/214 |
| 5,118,138 | 6/1992 | Brotz | 281/51 |
| 5,118,213 | 6/1992 | Merservy et al. | 402/80 R |
| 5,209,592 | 5/1993 | Bedol | 402/4 |
| 5,316,341 | 5/1994 | Schwartz | 281/15.1 |
| 5,375,883 | 12/1994 | Wyant | 281/37 |
| 5,409,319 | 4/1995 | Bedol | 402/1 |
| 5,460,414 | 10/1995 | Sargis | 281/38 |
| 5,476,336 | 12/1995 | Osiecki et al. | 402/79 |
| 5,498,089 | 3/1996 | Motyka | 402/4 |
| 5,503,489 | 4/1996 | Maudal | 402/80 L |
| 5,527,069 | 6/1996 | Bianco | 281/37 |
| 5,597,256 | 1/1997 | Burton et al. | 402/4 |
| 5,678,943 | 10/1997 | Parsons | 402/4 X |
| 5,695,294 | 12/1997 | Bedol et al. | 402/79 |
| 5,839,843 | 11/1998 | Bedol | 402/4 |

FOREIGN PATENT DOCUMENTS

| | | | |
|---|---|---|---|
| 835316 | 12/1938 | France | 402/4 |
| 64148 | 10/1955 | France | 402/4 |
| 1396190 | 3/1965 | France | 402/4 |
| 2575419 | 7/1986 | France | 402/80 R |
| 817440 | 10/1951 | Germany | 402/4 |
| 17022 | of 1909 | United Kingdom | 402/4 |
| 7081 | of 1910 | United Kingdom | 281/30 |
| 11652 | of 1912 | United Kingdom | 281/30 |
| 217484 | 6/1924 | United Kingdom | 402/4 |
| 1564220 | 4/1980 | United Kingdom | 281/30 |

*Primary Examiner*—Willmon Fridie, Jr.

[57] ABSTRACT

A combination book and storage assembly which includes a book having a substantially flat portion thereon and a storage apparatus securely attached to the book. The storage apparatus includes a rigid plate securely connected to the flat portion of the book and a storage assembly connected to the rigid plate. The storage assembly has two opposed surfaces for receiving at least one selected item positioned therebetween.

20 Claims, 10 Drawing Sheets

STORAGE APPARATUS FOR A BOOK

This Application is a Continuation-In-Part (CIP) of application Ser. No. 08/769,504, filed on Dec. 18, 1996, now U.S. Pat. No. 5,876,144, entitled, "ORGANIZER ASSEMBLY FOR REMOVABLE ATTACHMENT TO A RINGED NOTEBOOK OR RINGED BINDER."

BACKGROUND OF THE INVENTION

1. Field of the Invention

The present invention relates to storage mechanisms for storing items relative to books.

2. Description of the Related Art

Users of notebooks, including businessmen and students, often desire to have various articles such as tape dispensers, staples, etc. at their easy disposal when they use their notebook and to be secure from being lost when they carry their notebooks from one location to another.

In partial solution to this problem, present applicant Mark A. Bedol, invented a "Notebook Organizer Including Slidable Element", U.S. Pat. No. 5,050,736. The U.S. Pat. No. 5,050,736 patent discloses an organizer comprising a base with holes for engagement with the rings of a ringed notebook. The base includes a plurality of partitions which divide the base into a plurality of compartments. The patent also discloses an electronic calculator having a longitudinal extension thereon being slidably engageable with, and supported between, opposing partition surfaces.

Present applicant Mark A. Bedol, has also invented "Notebook Insert With Calculator and Holepunch", U.S. Pat. No. 5,209,592, which discloses a notebook insert comprising a housing, an electronic calculator attached to the housing and a holepunch assembly also attached to the housing. The housing has a periphery with multiple holes therethrough which are spaced to be adapted for engagement with the rings of a ringed notebook.

Present applicant, Mark A. Bedol, has also invented "Storage Apparatus for Ringed Notebook or Ringed Binder," U.S. Pat. No. 5,695,294, which discloses an apparatus for storing items in the volume formed within the rings of a ringed notebook or ringed binder. A main plate member having a plurality of spaced openings therethrough is provided. The spaced openings are arranged and sized so as to accommodate the rings of a ringed notebook or a ringed binder. A storage mechanism is provided for storing at least one selected item. The storage mechanism extends from the main plate member into the volume formed within the rings.

Although these prior art devices are effective in attempting to maximize the usable space within a notebook, the present invention provides a further way to exploit the volume within the rings of the notebook.

OBJECTS AND SUMMARY OF THE INVENTION

It is, therefore, a principal object of the present invention to provide optimal utilization of all of the space within a ringed notebook or ringed binder.

This and other objects are achieved by the present invention. In one broad aspect, the invention comprises a combination book and storage assembly which includes a book having a substantially flat portion thereon and a storage apparatus securely attached to the book. The storage apparatus includes a rigid plate securely connected to the flat portion of the book and a storage assembly connected to the rigid plate. The storage assembly has two opposed surfaces for receiving at least one selected item positioned therebetween.

In another broad aspect, the invention is a rotating storage apparatus for a book which comprises a rigid plate and a storage assembly that depends from the rigid plate. The storage assembly includes an arm assembly including a pair of opposed, spaced arms which are rotatable relative to the rigid plate. The spaced arms are stationary relative to each other. The spaced arms receive at least one selected item positioned therebetween.

In another broad aspect, the present invention is a storage apparatus for a book which includes a rigid plate; a hollow, cylindrical housing securely attached to the rigid plate; an antenna ball mount assembly slidably engageable within an inside surface of the hollow cylindrical housing; and, a storage assembly mounted on the antenna ball mount assembly arranged and constructed to be guided within the hollow, cylindrical housing by the antenna ball mount assembly.

As will be explained below, a variety of different items can be secured by the apparatus of the present invention.

Other objects, advantages, and novel features will become apparent from the following detailed description of the invention when considered in conjunction with the accompanying drawings.

DETAILED DESCRIPTION OF THE PREFERRED EMBODIMENTS

Figure 1:
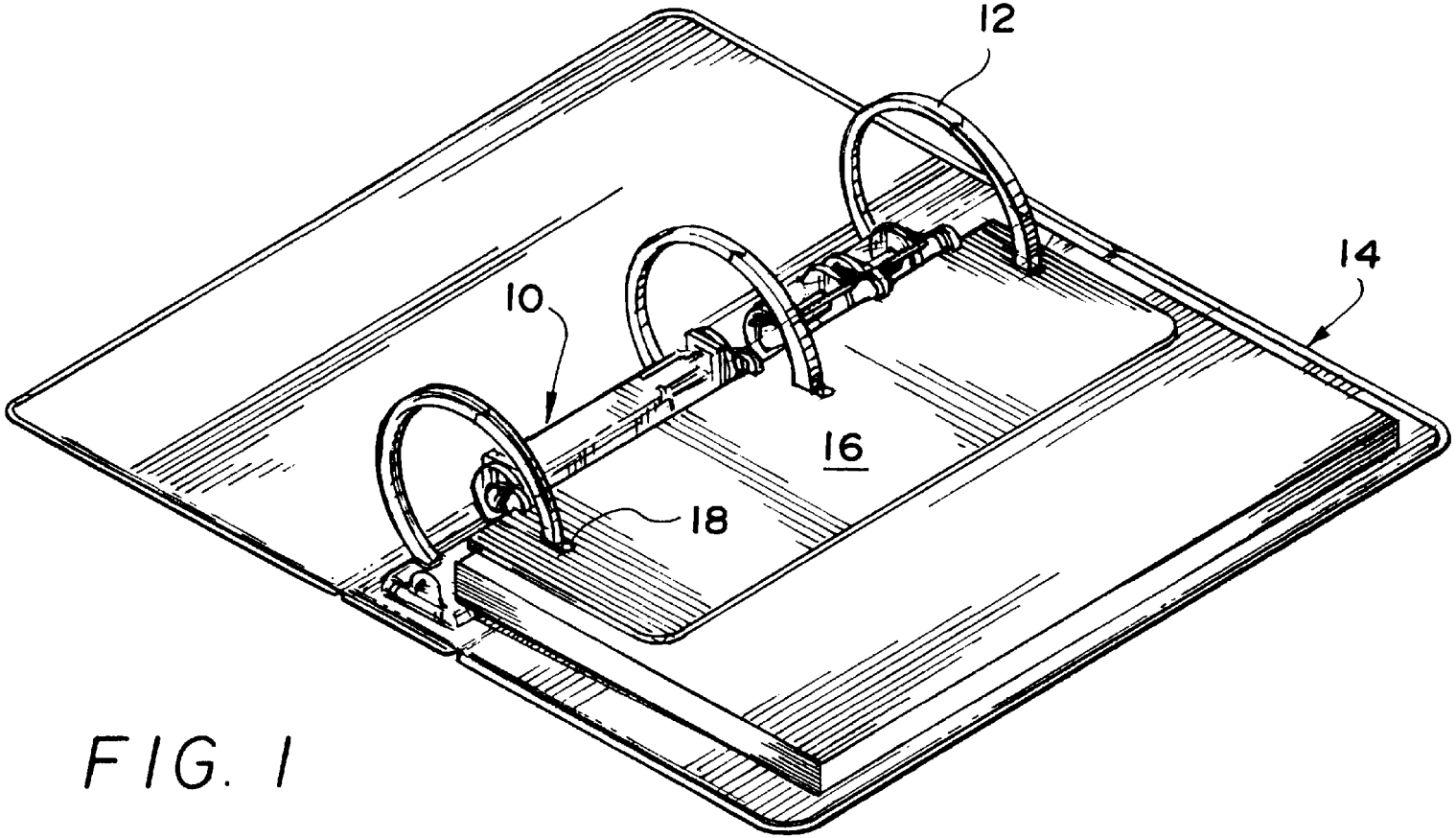
FIG. 1 is a perspective illustration of a first embodiment of a combination book and storage assembly of the present invention, showing the storage assembly positioned within a notebook.

Referring now to the drawings and the characters of reference marked thereon, FIG. 1 illustrates a first embodiment of the apparatus of the present invention, designated generally as 10, shown attached to the rings 12 of a conventional ringed binder, designated generally as 14. The apparatus 10 includes a rigid plate, designated generally as 16, having a plurality of spaced openings 18 therethrough (in this instance, three openings 18). The openings 18 are arranged and sized so as to accommodate the rings 12 of the ringed notebook or ringed binder 14. The rigid plate 16 may have a wipeable surface which is wipeable when used with a non-permanent ink. The wipeable surface may comprise a decal or label.

Figure 2:
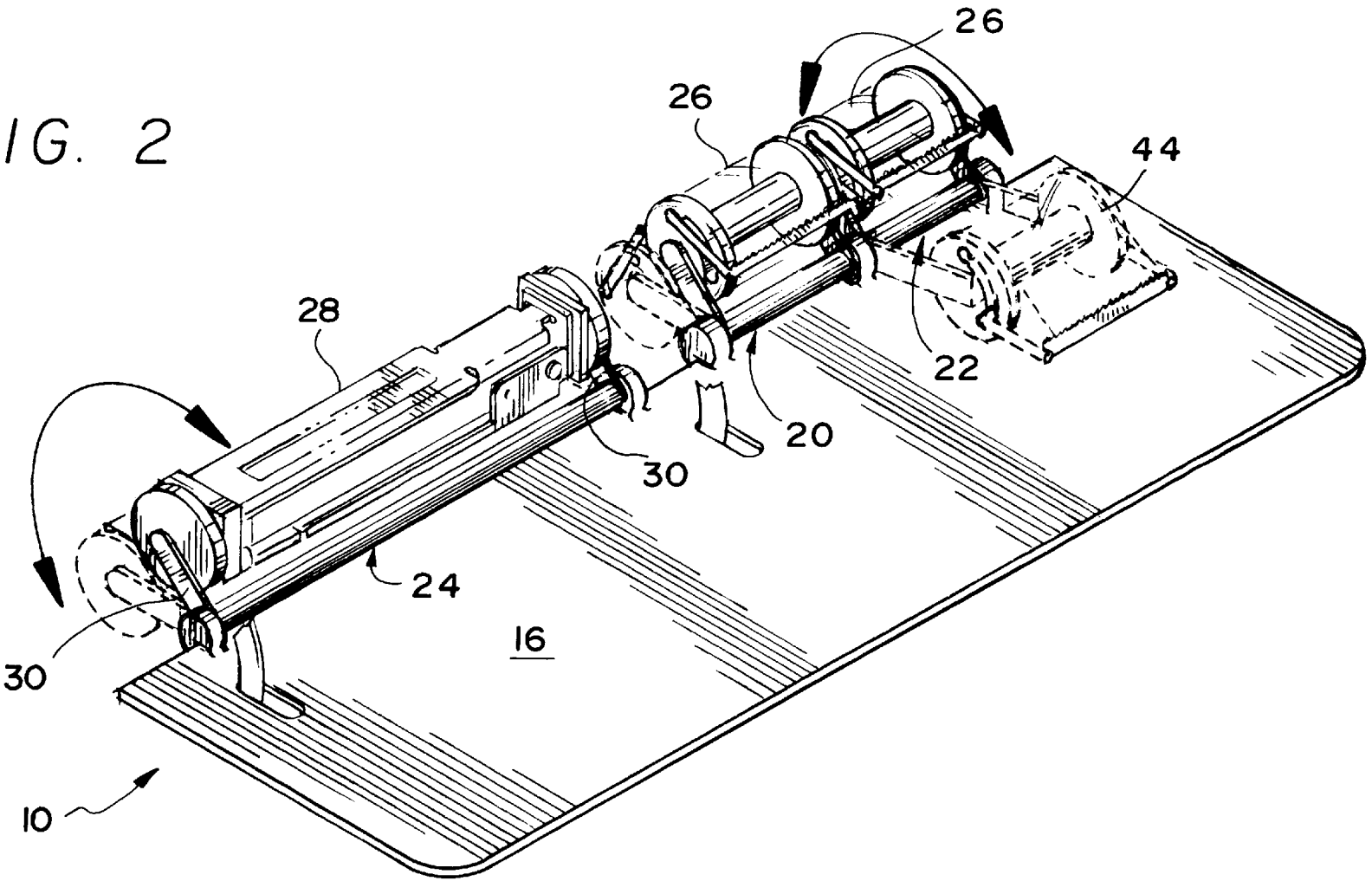
FIG. 2 is a perspective view of a storage assembly with a phantom line showing the operation of a rotating storage apparatus.

As can be seen most clearly in FIG. 2, the embodiment shown includes three storage assemblies, designated generally as 20, 22 and 24. Storage assemblies 20 and 22 are utilized to store rolls of tape 26. Storage assembly 24 stores a stapler 28. It is understood that the combination of storage assemblies that are illustrated in FIGS. 1 and 2 is shown by way of illustration and not limitation. Indeed, the storage assemblies embodied by the principles of the present invention can be used to store a variety of items, as will be explained below. However, in all of these instances, the storage assembly of the rotating storage apparatus 10 includes an arm assembly which includes a pair of opposed, spaced arms 30 which are rotatable relative to the rigid plate 16 and which are stationary relative to each other. These spaced arms 30 receive at least selected item, e.g. stapler 28, tape roll 26, positioned therebetween.

Figure 3:
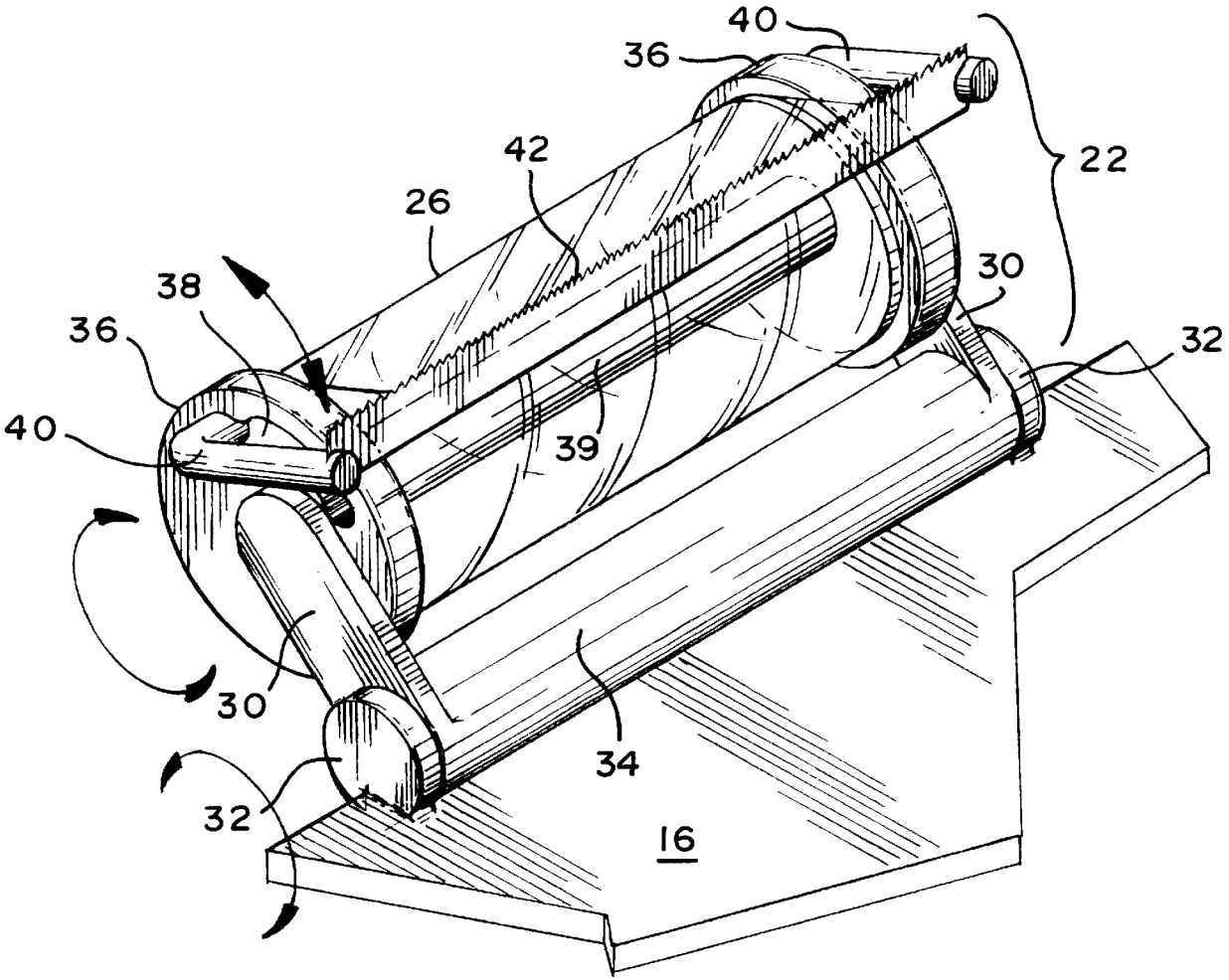
FIG. 3 is an enlarged perspective view of a rotating storage assembly of the present invention.

Referring now to FIG. 3, it can be readily seen that the storage assembly 22 includes a pair of spaced end members 32 which are secured to the rigid plate 16. The spaced arms 30 are rotatably mounted on the spaced end members 32. A connecting member 34 is integrally connected between the pair of spaced arms 30 for preventing any relative rotation therebetween. A pair of spaced holders 36 are included. Each spaced holder 36 is rotatably connected to a respective arm 30. Each holder is circular and includes a semi-circular slot 38 formed therein. A shaft 39 is connected between the pair of holders 36. Shaft 39 supports a roller 26 of dispensable material, e.g. tape. The storage assembly 22 includes a cutter assembly which includes a pair of extension rods 40 and a serrated cutter 42. Each extension rod 40 has a first end and a second end. Each extension rod 40 is substantially L-shaped, the second ends being directed inwardly toward each other to provide support of the cutter assembly between the holders 36. The serrated cutter 42 is positioned between the pair of extension rods 40 with opposite ends thereon which are each connected to a respective first end of an extension rod 40.

In the stowed position illustrated in FIG. 1, the storage assembly extends from the rigid plate 16 into the volume formed within the rings 12 so that the volume, which is normally unused, can be utilized to store the selected item, i.e. tape 26.

Figure 4:
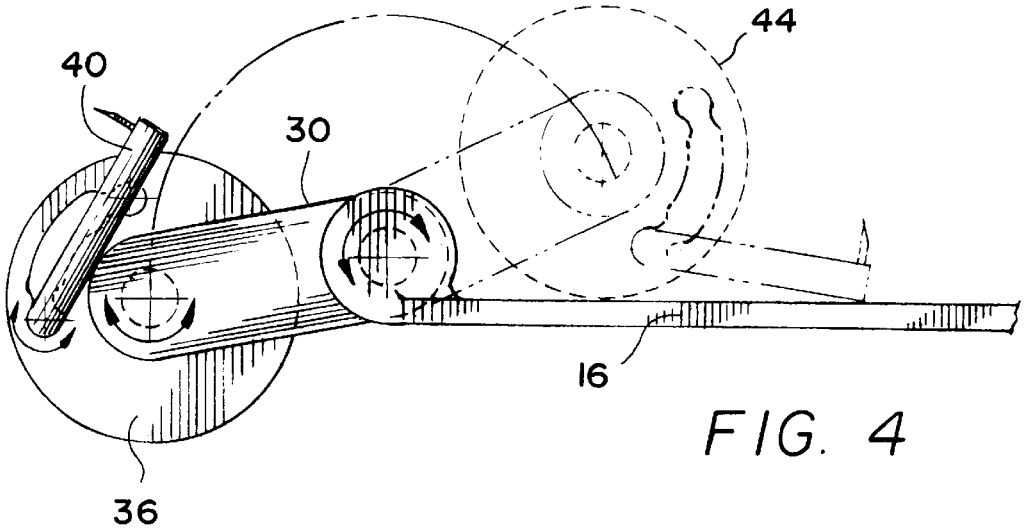
FIG. 4 is an end view of the rotating storage apparatus of the present invention.

During use, as shown by phantom lines 44 in FIGS. 2 and 4, the storage assembly is rotated so that the cutter assembly rests upon the rigid plate 16. In the tape stowed position, the tape is resting on the serrated cutter 42. In the fully wound up position, the tape would, without the serrated cutter 42, be difficult to grasp with one's hands. However, since the serrated cutter 42 serves as a "handle" for the end of the tape, the user needs to only grasp the serrated cutter 42 and move it toward the rigid plate 16. When moving the cutter 42, the tape unrolls and forms a space between the cutter 42 and the rolled up tape so that the user can grasp the tape with his fingers. The user may pull off the desired amount of tape and tear it off using the cutting edge. When finished, the user rolls up the tape and may simultaneously move the cutter 42 back into the stowed position within the slot 38. The user places the storage assembly 22 back into the volume formed within the rings of the binder by rotating the arms 30 backward relative to end members 32.

Figure 5:
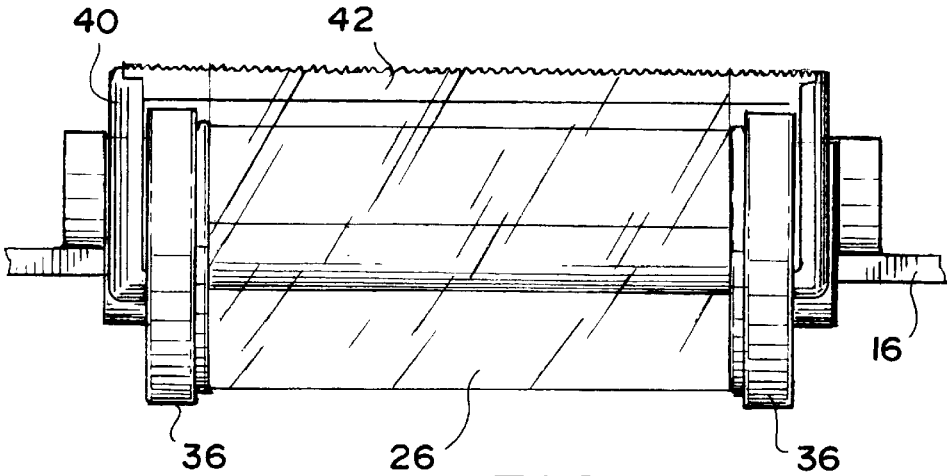
FIG. 5 is a back view of the rotating storage apparatus of FIG. 4.
Figure 6:
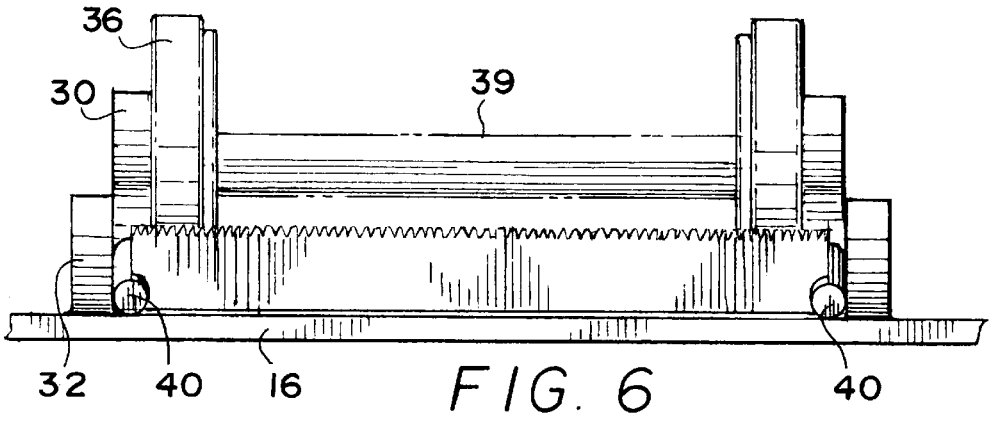
FIG. 6 is a front view of the phantom line showing of the rotating storage apparatus of FIG. 4.

FIG. 5 shows a back view of the rotating storage apparatus, while in a stowed position. FIG. 6 shows a front view of the rotating storage apparatus 10 while in the operative position.

As shown in FIGS. 1 and 2, a very similar storage assembly 24 can be used to support a stapler 28. Indeed, a variety of items may be stored by the storage assembly. These include, for example, a small flashlight, a glue stick or lipstick, a pill container, a recording device, a writing instrument, cylindrical radio, a cellular telephone, a document scanner such as a fax, a calculator, an electronic unit such as an e-mail device, an empty container, a miniature television, glue container, holepunch or a printer.

Figure 7:
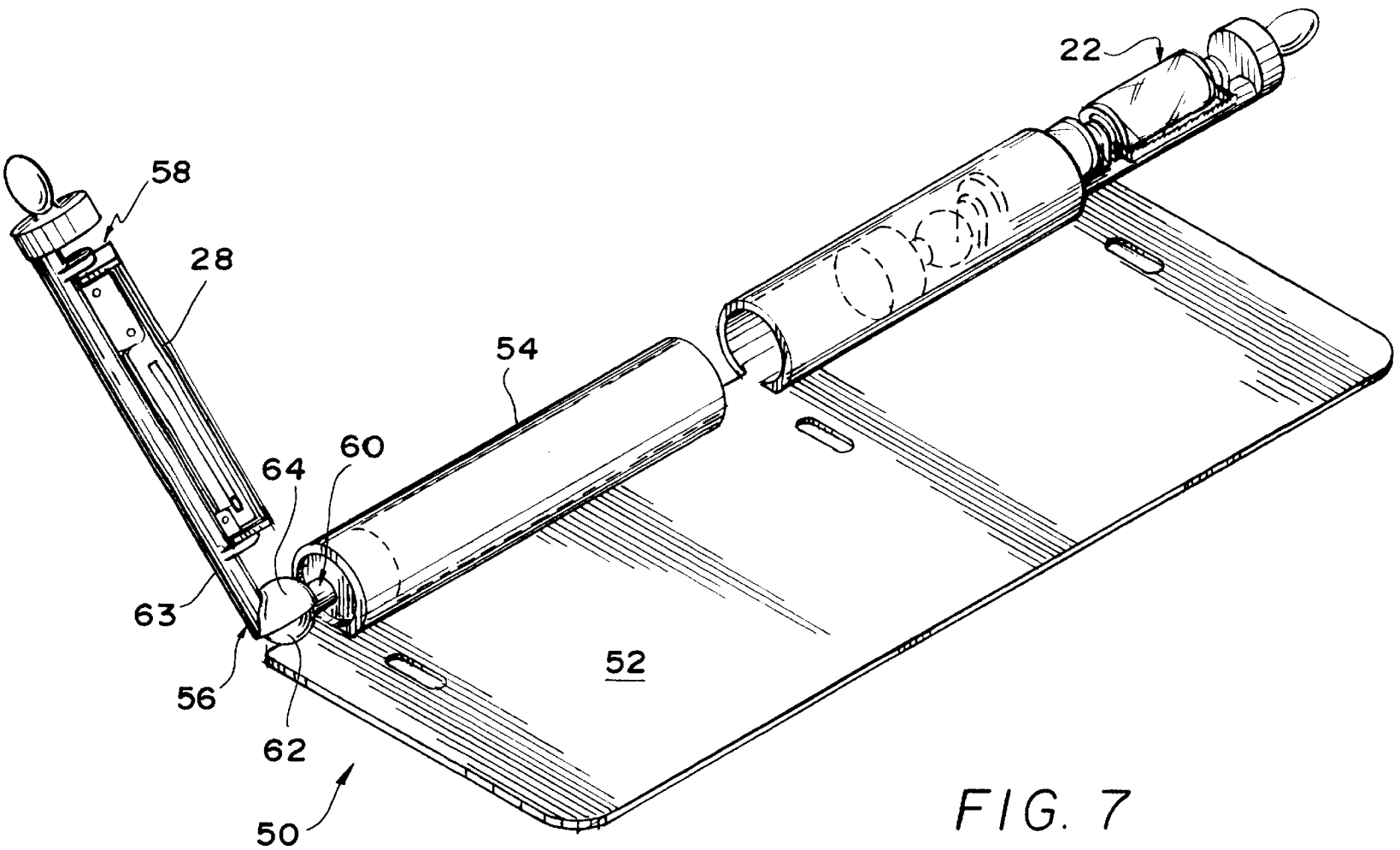
FIG. 7 is a perspective view of a second embodiment of the storage apparatus for a book of the present invention, shown in an operable extended position.
Figure 8:
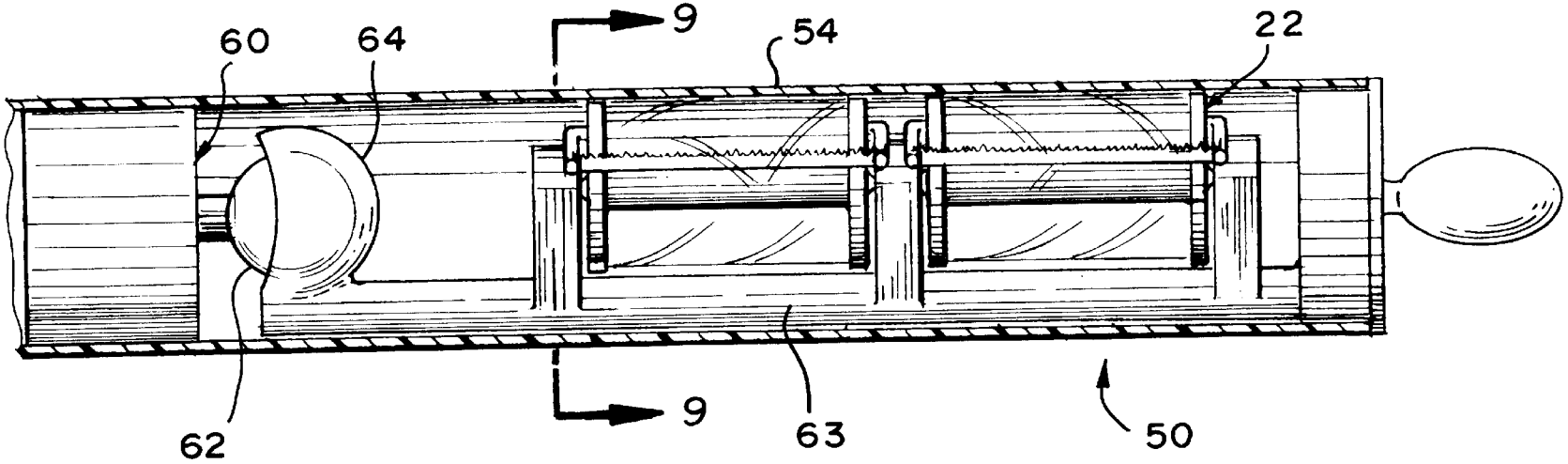
FIG. 8 is a cross-sectional view of a cylindrical housing and antenna ball mount assembly of the storage apparatus of FIG. 7.
Figure 9:
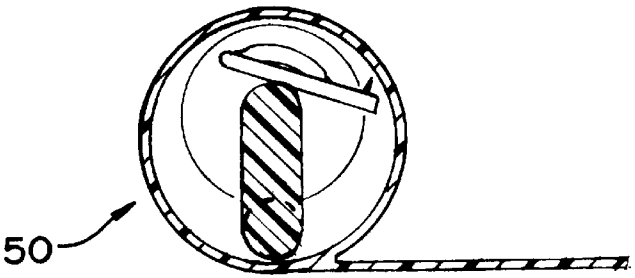
FIG. 9 is a view taken along Line 9—9 of FIG. 8.

Referring now to FIGS. 7–9, another embodiment of the present invention is illustrated, designated generally as 50. Storage apparatus 50 includes a rigid plate 52; a hollow cylindrical housing 54 securely attached to the rigid plate 52; an antenna ball mount assembly, designated generally as 56, slidably engageable within an inside surface of the hollow, cylindrical housing 54; and, a storage assembly, designated generally as 58, mounted on the antenna ball mount assembly 56. The storage assembly 58 is arranged and constructed to be guided within the hollow, cylindrical housing by the antenna ball mount assembly 56.

The antenna ball mount assembly 56 includes a piston assembly 60 mountable within the inside surface of the hollow, cylindrical housing 54. The piston assembly has a ball 62 on an end thereof. The antenna ball mount assembly 56 also includes a tray assembly 63 including a socket 64 thereon for operable engagement with the ball 62. The storage assembly 58 is mounted on the tray assembly 63. The storage assembly 58 may be of the type discussed with respect to the earlier figures.

Figure 10:
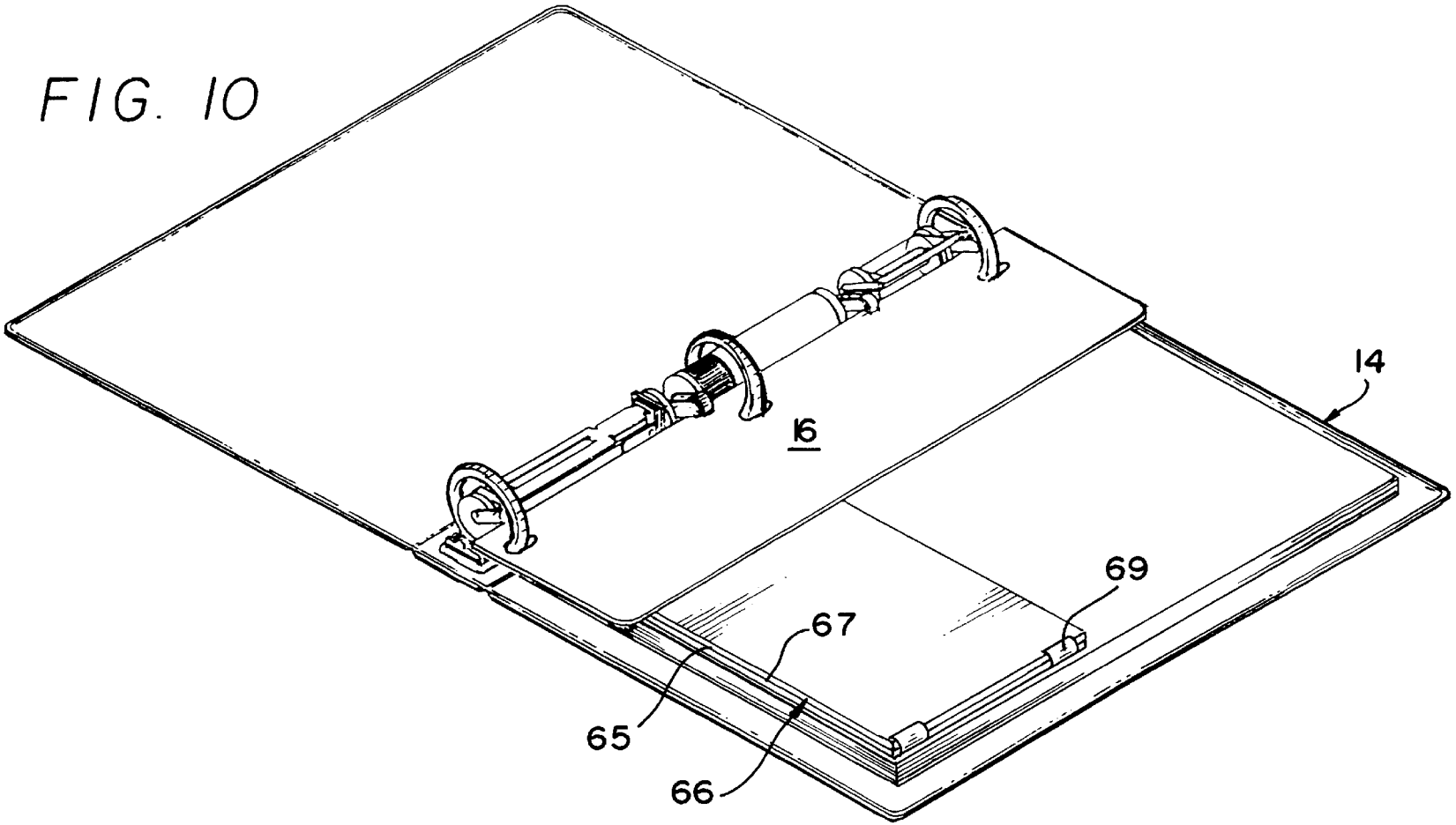
FIG. 10 is a perspective view of an embodiment of the present invention which has an electronic module attached to a rigid plate assembly which supports a storage element.
Figure 11:
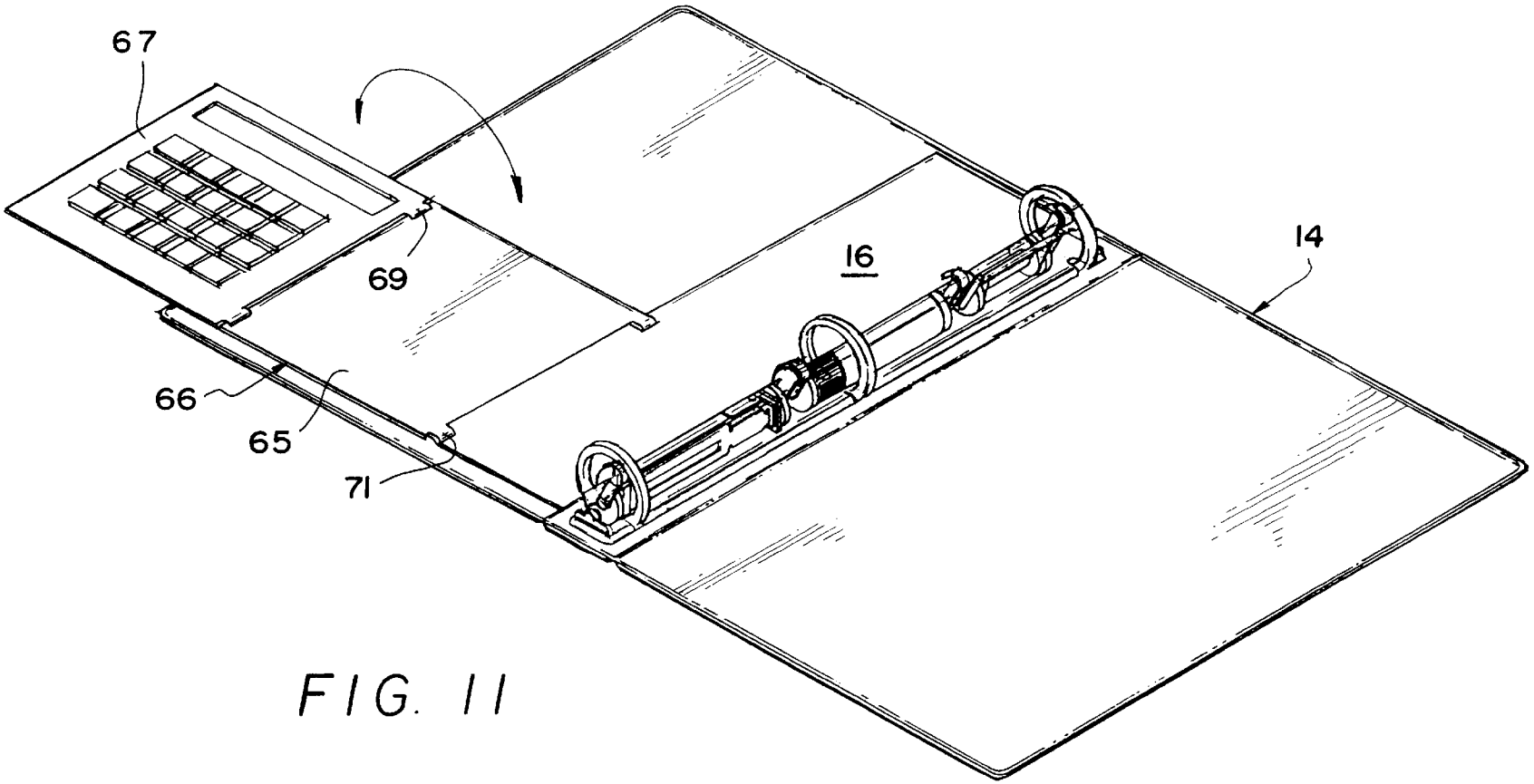
FIG. 11 shows the FIG. 10 embodiment turned to the other side of the notebook binder.

FIGS. 10 and 11 illustrate how various organizer (i.e. storage) assemblies can be hingedly or otherwise mounted to the rigid plate 16. For example, in the embodiment illustrated, a storage assembly, designated generally as 66, is securely connected to the side edge of the rigid plate 16. The storage assembly 66 includes a first storage assembly plate 65 rigidly secured to the rigid plate 16. A second storage assembly plate 67 is hingedly attached via hinges 69 to the first storage assembly plate 65. FIG. 11 shows the storage assembly 66 turned to the other side of the notebook binder and rotated to an operative position. In such an open position, the second storage assembly plate 67 extends beyond the perimeter of loose-leaf pages within the notebook binder. The second storage assembly plate 67 may comprise an electronic module such as a calculator. The storage assembly 66 may be attached to the rigid plate 16 by grooves, a snap-on mechanism, a hinge or other suitable securing needs. A snap-on mechanism 71 comprising a male hook and holder assembly, is shown in FIG. 11. The area of attachment of the second storage assembly plate 67 is preferably the outer edge of plate 65. Attachment means of the various plates may comprise, for example, sliding mating relationships.

Figure 12:
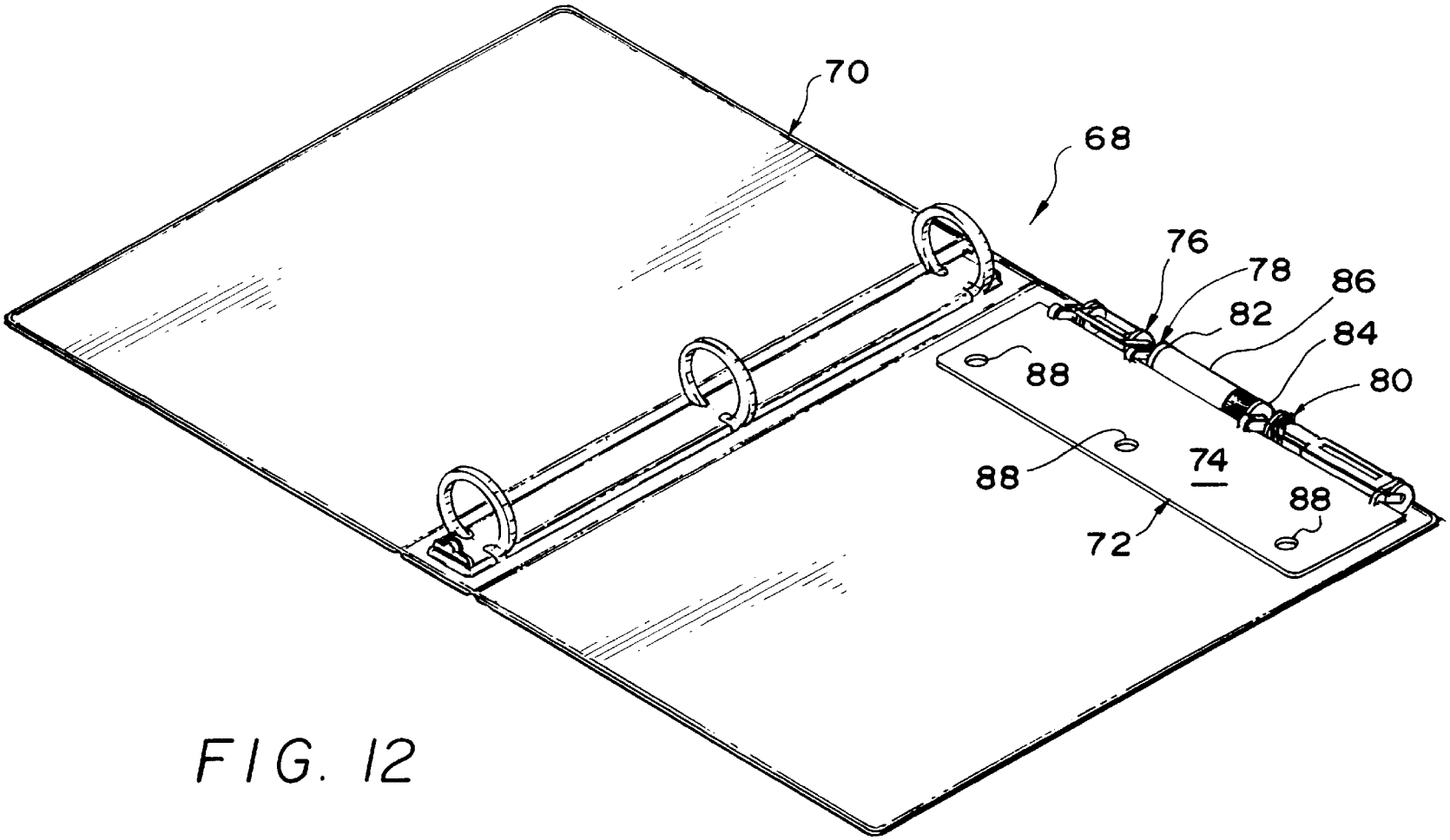
FIG. 12 is a perspective view of an embodiment in the present invention in which the rigid plate is attached to the cover of a binder.

Referring now FIG. 12, another embodiment of the present invention is illustrated, designated generally as 68. The combination book and storage assembly 68 includes a book 70 having a substantially flat portion thereon, such as a cover. A storage apparatus, designated generally as 72, is securely attached to the book 70. The storage apparatus includes a rigid plate 74 which is securely connected to the flat portion of the book 70. Storage assemblies 76, 78 and 80 are connected to the rigid plate 74. Each storage assembly has two opposed surfaces, e.g. 82 and 84, for receiving at least one selected item, e.g. 86, positioned therebetween. At least one fastening element 88, such as a rivet or screw, provides secure attachment of the rigid plate 74 to the book 70. The storage assembly 72 may be of the type discussed above. Other types of storage apparatus are considered to be within the purview of this invention, as described with respect this embodiment.

Figure 13:
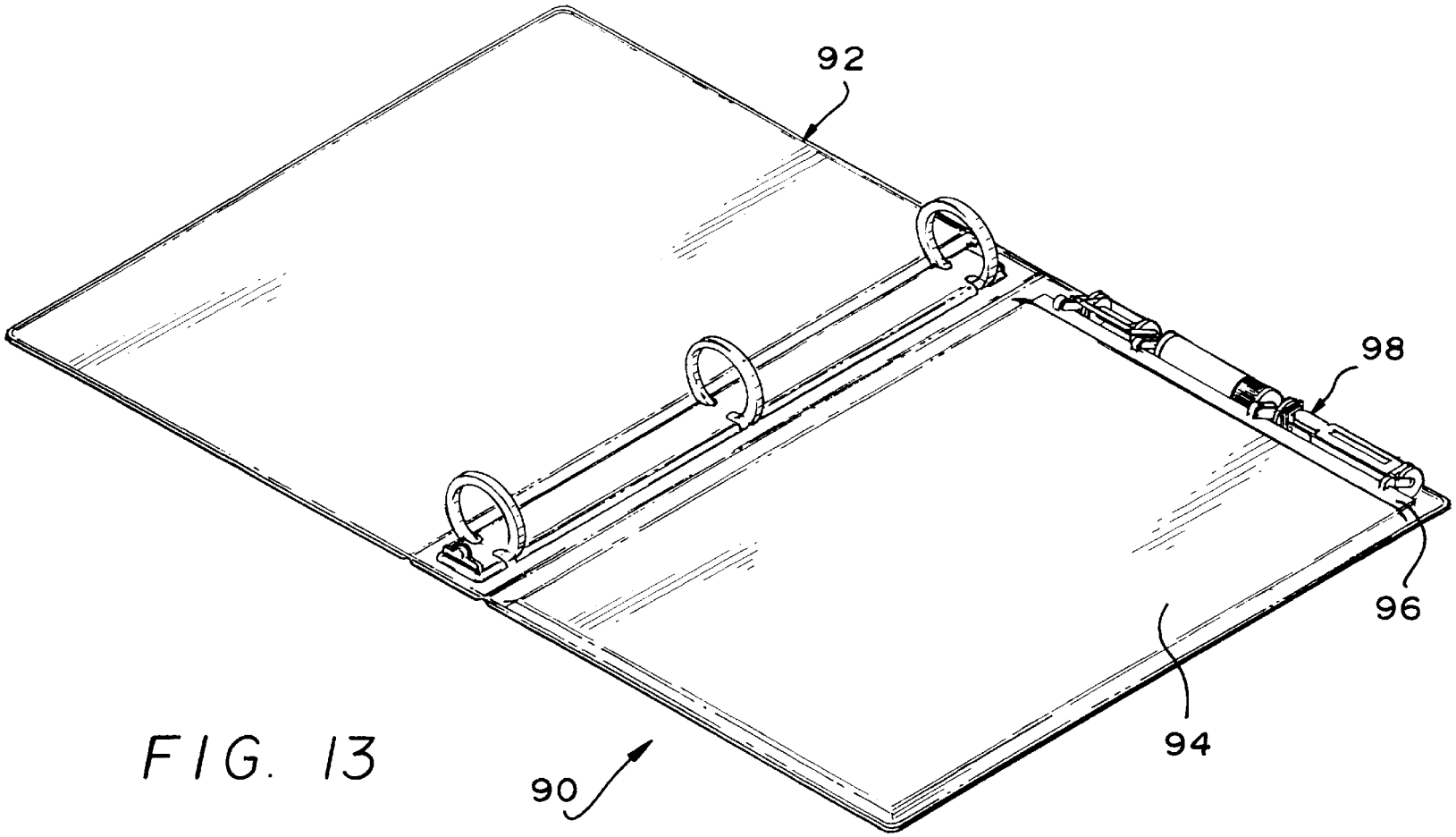
FIG. 13 is a perspective view of another embodiment which utilizes a pocket positioned on the binder into which the storage assembly slides into.

Referring now to FIG. 13, another embodiment of the present invention is illustrated, designated generally as 90. The combination book and storage assembly 90 includes a book 92 with a pocket 94 formed on a flat portion, e.g. cover, for insertion of a rigid plate 96 of a storage apparatus, designated generally as 98. The pocket 94 provides secure attachment of the storage apparatus 98.

Obviously, many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. A combination book and storage assembly, comprising:

a book having a substantially flat portion thereon; and, a storage apparatus securely attached to said book, said storage apparatus, comprising:

a rigid plate securely connected to said flat portion of said book; and, a storage assembly connected to said rigid plate, said storage assembly having two opposed surfaces for receiving at least one selected item positioned therebetween, wherein said book comprises a pocket on said flat portion for insertion of said rigid plate for providing said secure attachment of said storage apparatus.

2. The combination book and storage assembly of claim 1, wherein said book comprises at least one fastening element on said flat portion for providing said secure attachment of said storage apparatus.

3. The combination book and storage assembly of claim 1, said storage assembly including an arm assembly including a pair of opposed, spaced arms having said opposed surfaces, said arms being rotatable relative to said rigid plate, said spaced arms being stationary relative to each other.

4. A rotating storage apparatus for a book, comprising:

a rigid plate; and a storage assembly connected to said rigid plate, said storage assembly including an arm assembly including a pair of opposed, spaced arms which are rotatable relative to said rigid plate, said spaced arms being stationary relative to each other, said spaced arms for receiving at least one selected item positioned therebetween.

5. The rotating storage apparatus of claim 4, wherein said storage assembly, comprises:

a pair of spaced end members secured to said rigid plate, said spaced arms being rotatably mounted on said spaced end members;

a pair of spaced holders, each holder being rotatably connected to a respective arm of said spaced arms, each spaced holder having a slot formed therein;

a shaft connected between said pair of holders, said shaft for supporting a roller of dispensable material; and a cutter assembly having ends positioned within said slots.

6. The rotating storage apparatus of claim 5, wherein said cutter assembly, comprises:

a pair of extension rods, each extension rod having a first end and a second end; and a serrated cutter positioned between said pair of extension rods having opposite ends thereon which are each connected to a respective end of an extension rod, said second ends of said extension rod being said ends of said cutter assembly, which are positioned within said slots.

7. The rotating storage apparatus of claim 6, wherein each extension rod is substantially L-shaped, the second ends being directed inwardly toward each other to provide support of the cutter assembly between said holders.

8. The rotating storage apparatus of claim 6, wherein each holder is circular.

9. The rotating storage apparatus of claim 8, wherein each slot is semi-circular.

10. The rotating storage apparatus of claim 4, wherein said arm assembly further comprises a connecting member integrally connected between said pair of spaced arms for preventing any relative rotation therebetween.

11. A storage apparatus for a book, comprising:

a rigid plate;

a hollow, cylindrical housing securely attached to said rigid plate;

an antenna ball mount assembly slidably engagable within an inside surface of said hollow, cylindrical housing; and, a storage assembly mounted on said antenna ball mount assembly arranged and constructed to be guided within said hollow, cylindrical housing by said antenna ball mount assembly.

12. The storage apparatus of claim 11, wherein said antenna ball mount assembly, comprises:

a piston assembly mountable within said inside surface of said hollow, cylindrical housing, said piston assembly having a ball on an end thereof; and a tray assembly including a socket thereon for operable engagement with said ball, said storage assembly mounted on said tray assembly.

13. A storage apparatus for removable attachment to a host ringed notebook or ringed binder having a plurality of rings, said ringed notebook or ringed binder being of the type having a front cover and rear cover with loose-leaf pages positionable therebetween, said loose-leaf pages having smaller perimeters than said covers, said storage apparatus comprising:

a rigid plate having spaced openings for attachment to the rings of said ringed binder or ringed notebook, said rigid plate having a side edge thereon; and a storage assembly operably attached to said side edge, said assembly being positionable in a closed position and an operative position, wherein when said storage assembly is in said operative position a portion thereon extends beyond the perimeter of said loose-leaf pages, and, wherein sold storage assembly comprising;

a first storage assembly plate rigidly secured to said rigid plate; and a second storage assembly plate hingedly attached to said first storage assembly plate, said second storage assembly plate including said portion that extends beyond the perimeter.

14. The combination book and storage assembly of claim 3, wherein said storage assembly, comprises:

a pair of spaced end members secured to said rigid plate, said spaced arms being rotatably mounted on said spaced end members;

a pair of spaced holders, each holder being rotatably connected to a respective arm of said spaced arms, each spaced holder having a slot formed therein;

a shaft connected between said pair of holders, said shaft for supporting a roller of dispensable material; and a cutter assembly having ends positioned within said slots.

15. The combination book and storage assembly of claim 14, wherein said cutter assembly, comprises:

a pair of extension rods, each extension rod having a first end and a second end; and a serrated cutter positioned between said pair of extension rods having opposite ends thereon which are each connected to a respective end of an extension rod, said second ends of said extension rod being said ends of said cutter assembly, which are positioned within said slots.

16. The combination book and storage assembly of claim 15, wherein each extension rod is substantially L-shaped, the second ends being directed inwardly toward each other to provide support of the cutter assembly between said holders.

17. The combination book and storage assembly of claim 15, wherein each holder is circular.

18. The combination book and storage assembly of claim 1, wherein said rigid plate comprises a wipeable surface, said surface being wipeable when used with a non-permanent ink.

19. The storage apparatus of claim 11, wherein said rigid plate comprises a wipeable surface, said surface being wipeable when used with a non-permanent ink.

20. The storage apparatus of claim 13, wherein said rigid plate comprises a wipeable surface, said surface being wipeable when used with a non-permanent ink.

* * * * *